US005433577A

United States Patent [19]

Roycraft

[11] Patent Number: 5,433,577

[45] Date of Patent: Jul. 18, 1995

[54] REFUSE BAG OPENER

[75] Inventor: Frank Roycraft, Mansfield, Ohio

[73] Assignee: Magnificent Machinery, Inc., Cleveland, Ohio

[21] Appl. No.: 241,202

[22] Filed: May 11, 1994

[51] Int. Cl.[6] ..... B02C 19/22

[52] U.S. Cl. ..... 414/412; 414/326; 414/411; 198/677; 241/260.1

[58] Field of Search ..... 414/403, 411, 412, 326, 414/786; 198/658, 676, 677; 241/260.1

[56] References Cited

U.S. PATENT DOCUMENTS

| | | | |
|---|---|---|---|
| 2,717,742 | 9/1955 | Weigham et al. . | |
| 3,807,470 | 4/1974 | Young . | |
| 3,860,182 | 1/1975 | Peterson . | |
| 4,043,514 | 8/1977 | Peterson . | |
| 4,077,575 | 3/1978 | Tillmanns . | |
| 4,181,461 | 1/1980 | Bernicot . | |
| 4,182,592 | 1/1980 | Henryson | 414/412 |
| 4,220,434 | 9/1980 | Letzig | 414/326 |
| 4,265,584 | 5/1981 | Duwell et al. . | |
| 4,274,787 | 6/1981 | Mueller et al. . | |
| 4,278,384 | 7/1981 | Marchesini | 414/412 |
| 4,466,533 | 8/1984 | Shwayder | 198/677 X |
| 4,519,496 | 5/1985 | Ludvigsen | 198/677 X |
| 4,555,212 | 11/1985 | Jones . | |
| 4,852,817 | 8/1989 | Tipton . | |
| 4,881,862 | 11/1989 | Dick | 414/326 X |
| 4,930,968 | 6/1990 | Borglund | 414/412 |
| 4,995,770 | 2/1991 | Crane . | |
| 5,002,451 | 3/1991 | Hale et al. . | |
| 5,232,168 | 8/1993 | Lybecker et al. . | |

FOREIGN PATENT DOCUMENTS

| | | | |
|---|---|---|---|
| 0571050 | 2/1959 | Canada . | |
| 474538 | 3/1992 | European Pat. Off. | 241/260.1 |
| 4057728 | 2/1992 | Japan . | |
| 2054406 | 2/1981 | United Kingdom | 241/260.1 |
| 0621615 | 8/1978 | U.S.S.R. . | |
| 1150167 | 4/1985 | U.S.S.R. | 414/412 |
| 1330021 | 8/1987 | U.S.S.R. . | |
| 1335507 | 9/1987 | U.S.S.R. . | |

*Primary Examiner*—Frank E. Werner

*Attorney, Agent, or Firm*—Renner, Otto, Boisselle & Sklar

[57] ABSTRACT

A bag opening machine includes a trough and a feed screw that is rotatably mounted in the trough to advance bags that at least partially fit between the flight of the feed screw along the length of the trough. There are a pair of restrictions that the bags encounter that cause the bags to be ripped open. The machine has a shear plate running the length of the trough which provides a surface against which bags between the flight rub to be opened. The flight of the conveyor is provided with pins which project generally in a down stream direction and assist in ripping open bags. Each of the restrictions is lined with another shear plate. An expansion chamber is located between the two restrictions. The restrictions completely surround the feed screw, which is mounted eccentrically in the opening defined by the feed screw. A hinged lid over the expansion chamber helps prevent the build-up of excess material. At the outlet end, the feed screw has a conical anti-clogging device that directs materials out of the feed screw, especially long strips that might have gotten wrapped around the feed screw.

7 Claims, 3 Drawing Sheets

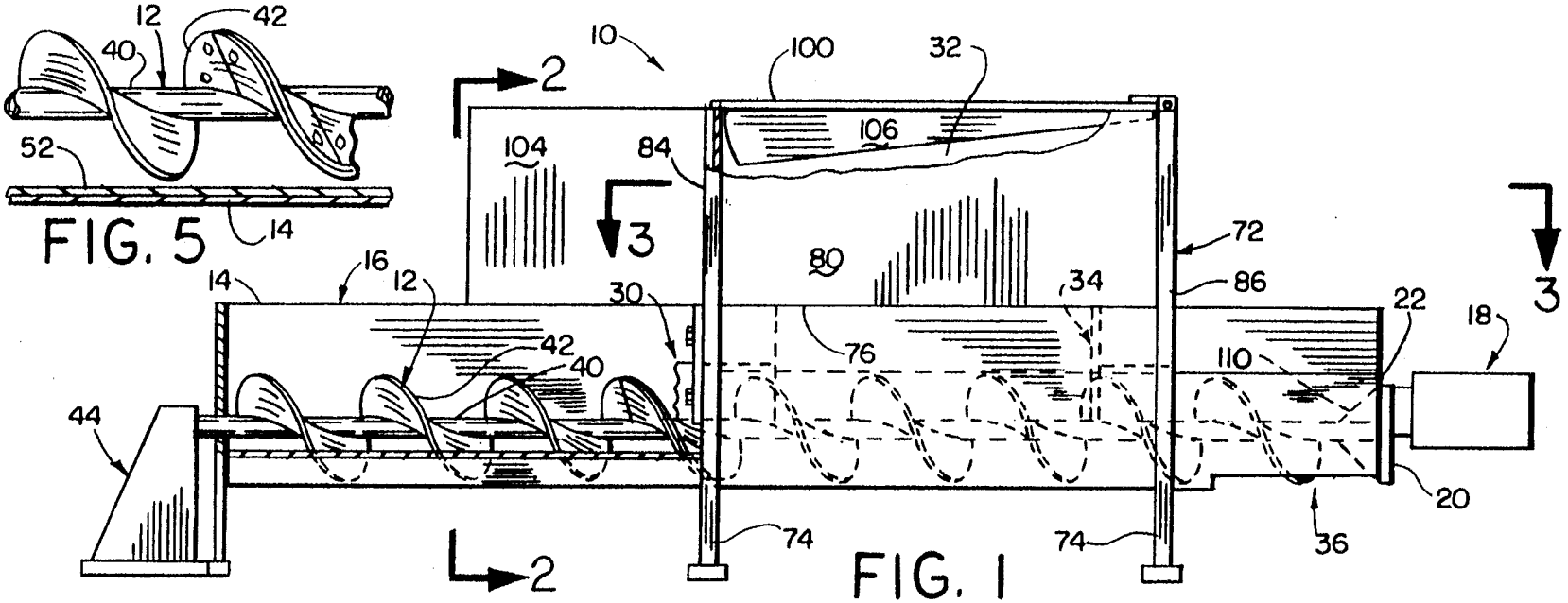
FIG. 1
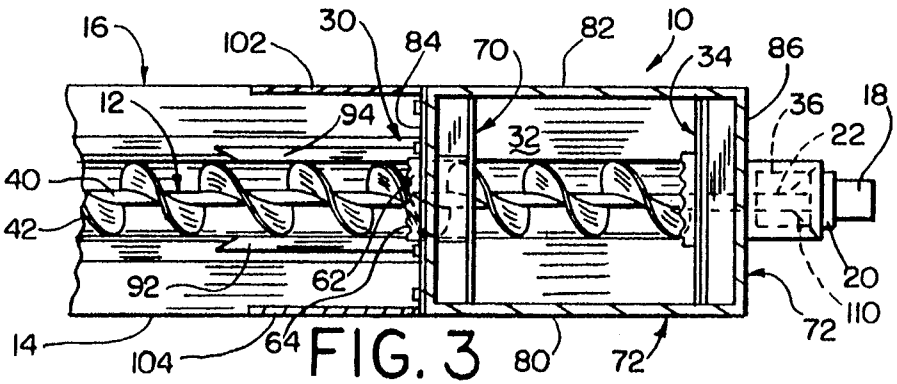
FIG. 3
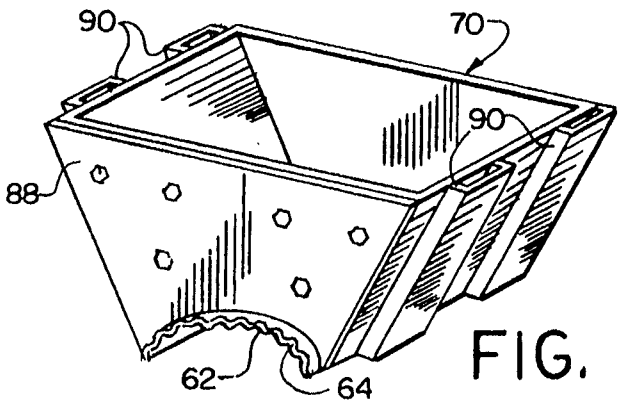
FIG. 4
FIG. 5

REFUSE BAG OPENER

FIELD OF THE INVENTION

The present invention relates to automated openers for bags containing refuse, especially recyclable refuse, and to such a bag opener with improved efficiency, wear, and safety characteristics.

BACKGROUND OF THE INVENTION

In the recycling industry, one substantial problem is to open bags containing recyclable materials. This problem arises because many communities require residents to place all their recyclables in a single plastic or heavy duty paper bag. These bags are then collected and delivered to a recycling center where the bags are opened, and the various recyclable materials are sorted.

Reliably and safely opening the bags is a difficult task, and many recycling centers have been able to accomplish this task only with excessive manual labor. The difficulty arises in part because the bags must be made strong enough to withstand the rough handling they are likely to encounter between the time residents fill the bags and the time they arrive at the recycling center. The toughness which allows the bags to arrive intact also makes them hard to open.

A second problem any bag opener must address is worker safety. The bags of recyclables may not only contain relatively benign items such as empty plastic beverage containers, but they may also contain more dangerous items such as propane tanks and aerosol cans of various types. These containers and their contents may pose significant hazards to those who must work sorting the contents of bags containing recyclable materials. An automated bag opener should be able to open bags while breaking as few of the contents as possible, and do this at a speed that makes the financial investment in bag opening machinery economical compared to the manual alternative.

Further the bags may contain materials that could easily damage any equipment used to open the bags. Such materials include large pieces of lumber, e.g., odd bits of 4"×4", as well as glass. Glass poses a special problem since when it is broken, it is difficult or impossible to sort into the appropriate recycling category, and broken glass is exceedingly abrasive and therefore causes excessive wear on any machinery it contacts. A machine that is used to open bags must be able to safely handle all of these materials with a minimum of down time for repairs.

Equipment available before now has addressed some of these problems but has not been entirely successful in addressing the wear problem caused by abrasive materials, and worker safety and efficiency can always be improved. One prior art device for opening bags is that illustrated in U.S. Pat. No. 4,555,212. It includes a feed screw positioned in a tube. The tube has been partially cut away to form an inlet area at one end of the screw and a discharge area at the opposite end of the screw. The inlet area has wings that form a trough to direct bags toward the feed screw. Two portions of the tube between the inlet and discharge areas remain intact. In these two portions the tube completely surrounds the feed screw to form restrictions where the bags are severed. An expansion chamber is located between the two restrictions. In the expansion chamber the recyclables and any unopened bags are tumbled before going through the second, bag-rupturing restriction. After the feed screw advances the bags and their contents through the second restriction, they move to the discharge area where they spill onto a conveyor belt for further sorting.

The device described has proven effective, but it is also subject to premature wear, and it may have difficulty dealing with materials that are not easy to shear. The expansion chamber is open and might present a hazard. Moreover the feed rate of the screw must sometimes be slowed down because material accumulates in the expansion chamber.

SUMMARY OF THE PRESENT INVENTION

The present invention provides a number of significant advantages over prior art machines like that shown in U.S. Pat. No. 4,555,212, the entire disclosure of which is incorporated herein by reference. Specifically, the trough of the present invention includes a shear plate running the length of the trough under the feed screw to provide added durability and an edge against which bags containing recyclables, especially small bags, may be sheared open. Additionally, shear plates line the top part of each restriction. These shear plates each have a serrated leading edge which engages the bags and friable contents of the bags to help shear them. Each restriction has a face perpendicular to the axis of the feed screw which is protected by a replaceable wear plate.

The feed screw is provided with a reinforcing and wear plate on the convolution of the screw that passes through the first restriction. This reinforcing plate is removable so that when it is worn it may be replaced. Moreover the reinforcing, wear plate is held in place with bolts that extend through the helical feed screw surface and the wear plate and have a free end extending about two inches beyond the wear plate. The free ends of the bolts have been found to produce a significant improvement in the opening of bags, especially smaller plastic bags that may be included inside larger bags.

The shape of the restrictions has also been selected to increase effectiveness. To this end the restriction and the trough together make an eccentric opening through which the feed screw passes. The clearance between the feed screw and the restriction is smallest at the bottom of the trough and largest at the top, with the clearance being selected to allow ample through-put speeds while keeping breakage of glass to a minimum.

Between the two restrictions is an expansion chamber covered with a movable lid which tends to force excess material in the expansion chamber back into the feed screw. In the event that recyclable materials build up in the expansion chamber, the pressure will cause the lid to lift, thereby alerting the machine operators. The lid is arranged so that as it opens, materials within are exposed only to one direction. Should the materials overflow the expansion chamber, the detritus will be directed back into the trough upstream of the first restriction. In the unlikely event of an explosion, the explosive force will be directed in a single direction, away from the workers.

Additionally, the present invention provides an anti-jamming disc at its discharge end. This disc deflects into the discharge opening materials which might get stuck on or wrapped around the feed screw, such as long pieces of wire or plastic.

BRIEF DESCRIPTION OF THE FIGURES

FIG. 1 is a side elevation view of an improved refuse bag opener constructed in accordance with the present invention, with the trough thereof partly in section to reveal the feed screw;

FIG. 3 is a view looking in the direction of arrows 3—3 in FIG. 1;

FIG. 4 is a perspective view of an element forming a part of the restriction of FIG. 1;

FIG. 5 is an enlarged view of a portion of the feed screw of FIG. 1 showing reinforcement of the feed screw in the region of the first restriction.

DESCRIPTION OF PREFERRED EMBODIMENT

Figure 2:
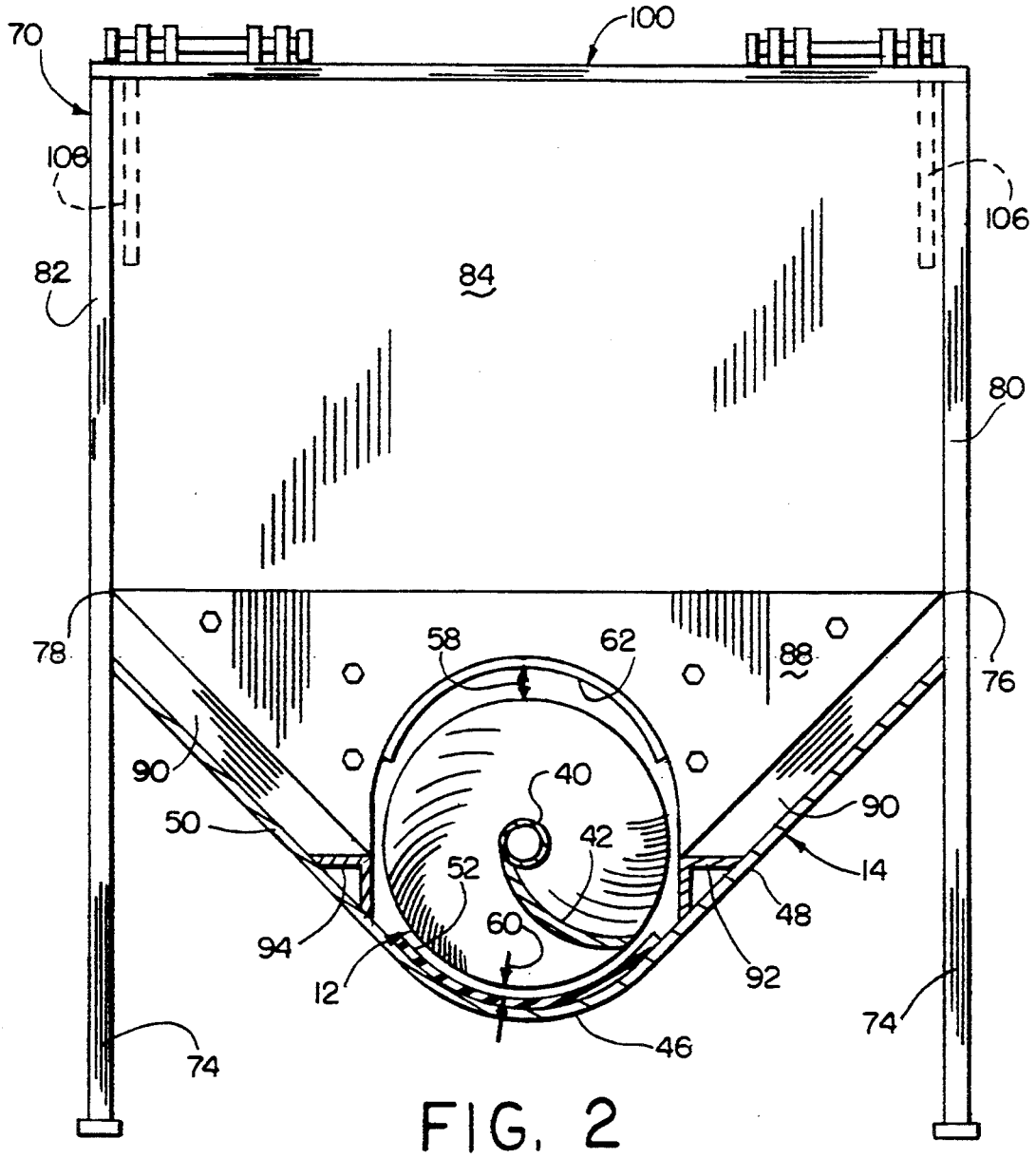
FIG. 2 is sectional view looking in the direction of arrows 2—2 of FIG. 1 showing a shear plate lining the bottom of the trough, the first restriction, and the shear and wear plates on the first restriction.

FIG. 1 illustrates an improved apparatus 10 for rupturing bags constructed according to the precepts of the present invention. The apparatus 10 includes a feed screw 12 supported in a transport trough 14 which surrounds a portion of the bottom of the feed screw, leaving the top exposed. The trough 14 forms an inlet end 16 where bags containing recyclables may be dumped. The feed screw 12 is driven by a suitable motor such as the electric motor 18 and reduction gearing 20 mounted on end wall 22 which closes the end of the trough 14.

The feed screw 12 carries bags containing recyclables through a two stage rupturing process. The bags encounter a first restriction 30 which opens most of the bags. The contents and the ruptured bags move through the first restriction 30 into an expansion chamber 32 where they are agitated, and then they pass through a second restriction 34 where the majority of any unopened bags are ruptured. Ultimately the bags and their contents are discharged from a discharge opening 36 onto a conveyor (not shown) for further sorting and processing.

The feed screw 12 is formed of a 5 inch diameter steel tube 40 (FIGS. 1 and 2), and a helical flight 42 which has a 24 inch diameter. The flight 42 makes a complete revolution each 24 inches of the tube 40. The feed screw 12 is supported by a mounting assembly 44 at its inlet end. The mounting assembly 44 includes a conventional thrust bearing (not shown). The opposite end of the feed screw is also mounted with a conventional thrust bearing (not shown). The thrust bearings hold the feed screw 12 above the bottom of the trough 14, as shown in FIG. 2. In a preferred embodiment the tube is a Schedule 80 pipe and the flight is one-half inch mild steel. Further in this preferred embodiment the feed screw 12 may be reinforced from the convolution of the flight 42 that immediately precedes the first restriction 30 and continues through that restriction as shown in FIG. 5.

Figure 6:
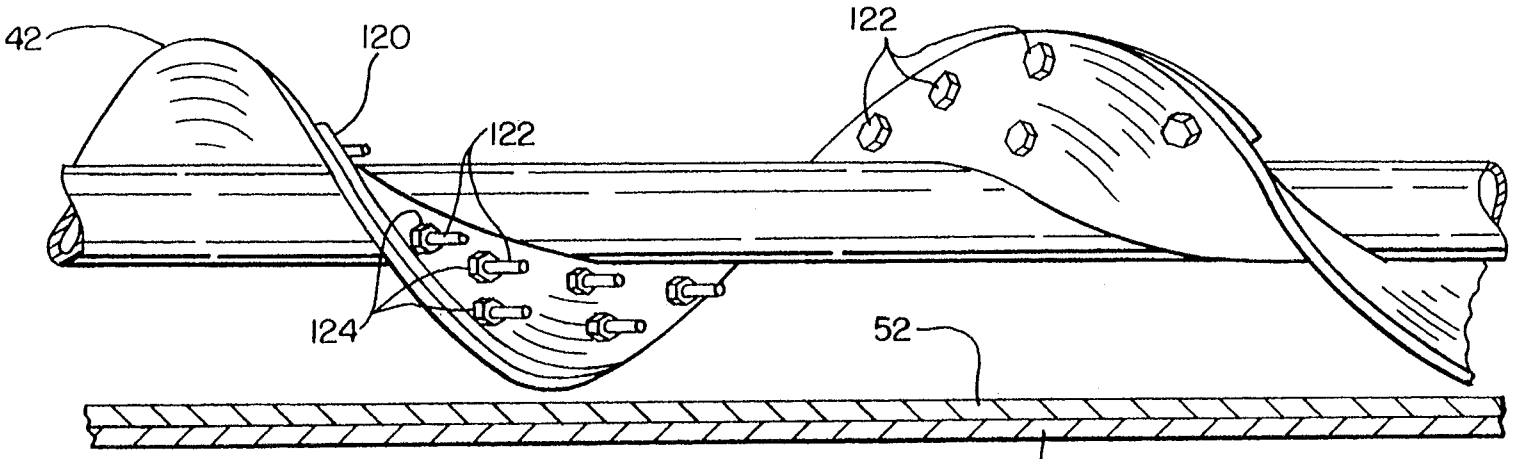
FIG. 6 is an enlarged view similar to FIG. 5 showing a convolution of the feed screw in the region of the first restriction and also showing the bolts which mount the replaceable wear/reinforcement plate.

As illustrated in FIG. 6, the reinforcement is in the form of a replaceable wear plate 120. In practice more than one wear plate may be necessary in order to easily replace the plate(s) when worn. The wear plate 120 is held in place by means of a number of bolts 122 and cooperating nuts 124. The bolts are about two inches longer that the combined thickness of the screw conveyor flight 42 and the wear plate 120. In this manner, the bolts 122 extend perpendicular to the face of the wear plate 120 and generally in the direction of feed of the screw conveyor. The bolts 122 each point in a slightly different direction because of the helical nature of the flight 42. In one embodiment the flight has a diameter of twenty-four inches and completes a complete convolution in twenty-four inches. Other diameters and pitches are possible, and changing the pitch would affect the angle which each bolt makes with the flight.

It has been discovered that the bolts 122 improve the operation significantly of the bag rupturing apparatus 10, and this effect is especially pronounced in opening smaller bags. For example, many people use thirty-three gallon trash bags, and may be required to so by their municipality or refuse hauler. In addition, some people use smaller bags within the big bag, and these smaller bags have sometimes gotten through the restrictions without being opened. The bolts 122 increase the efficiency of bag opening substantially. Moreover, perhaps because of ther angle which the bolts make to the direction offlow of ther material being conveyed, the bolts do not seem to accumulate material. The bolts 122 seem to be self-cleaning. While the use of the bolts 122 to perform the combined function of mounting the replaceable wear plates and the helping to tear open smaller bags is preferred, the invention could also be accomplished by separating these functions, having the bag opening function performed by studs or pins which project from the wear plate and having the wear plate held in place with fasteners that do not project substantially beyond the face of the wear plate 120. Moreover, the advantages of the pins could be accomplished without the wear plate by simply mounting the pins or bolts 122 to the flight 42 of the conveyor.

In cross-section the trough 14 (FIG. 2) has the shape of a rounded V. The rounded, bottom portion 46 of the trough 14 surrounds about one quarter of the flight 42 of the feed screw 12. From opposite sides of the rounded portion 46, straight walls 48 and 50 extend upward at about 90 degrees to each other. The trough 14 extends the entire length of the feed screw 12 as shown in FIG. 1. At the inlet end 16 the trough 14 is open upward, and so forms a place where bags containing recyclable refuse can be placed in the machine 10.

The trough 14 is partially lined with a shear plate 52 (FIG. 2) that extends the entire length of the trough from the inlet end to the upstream end of the discharge opening 38. This shear plate 52 performs two functions. First, it provides a replaceable element which extends the life of the trough 14. Also it presents a lengthwise edge 54 in the trough 14. Bags that are smaller than standard might fit completely between the flight 42 of the feed screw 12 and pass through the restrictions 30 and 34 unopened. These bags tend to be sheared open by the edge 54 of the reinforcing plate 52.

When a bag containing recyclable materials is placed in the trough 14, part of the bag fits between the flight 42 of the feed screw 12. As the feed screw 12 turns, the bag advances along the conveyor until it hits the first restriction 30. When the bag arrives at the restriction 30, it is effectively sheared open because a portion of the bag and its contents fits between the flight 42 of the feed screw 12 and is pulled downstream while the remaining portion is blocked from further advancement by the restriction 30. As the bag is sheared open, the items within it fall down into the spaces between the feed screw flight 42 and advance downstream in the trough 14.

The restrictions 30 and 34 are substantially identical, and only the restriction 30 is shown or described in detail. However, it will be understood that this description applies equally to the restriction 34. The restriction 30 is shaped for maximum wear and for efficiency. The restriction 30 is shaped so that the feed screw 12 is eccentric, with a larger clearance 58 between the feed screw 12 and the restrictions at the top than at the bottom 60. It has been found that a uniform clearance of, for example, one half inch, as used in the prior art device described above, does not operate efficiently. While such a clearance results in little unnecessary glass breakage, it also results in a machine that tends to bog down. By increasing the clearance 58 at the top of the feed screw to between 2.5 and 3.5 inches, the feed screw speed can be increased. However, if the clearance is larger than that specified, then glass breakage increases, and this in turn results in rapid abrasion of the machinery and unnecessary loss of recyclable materials.

The restriction 30 is faced with a shear plate 62 (FIGS. 2 and 3) that extends along the length of the feed screw 12. The shear plate 62 is semi-circular with a 12.5 inch radius. The leading edge 64 of the shear plate 62 is serrated with a wavy edge. This leading edge 64 helps to grab the bag material as it is being forced through the restriction 30 and to shear some oversized recyclables.

The restriction 30 is formed by inserting a shroud 70 (FIG. 4) into the expansion chamber 32. The expansion chamber 32 is a rectangular box 72 open on its bottom and mounted on legs 74 which straddle a part on the trough 14 and feed screw 12. The bottom edges 76 and 78 of the front and rear walls 80 and 82, respectively, of the box 70 are connected to the upper edges of the walls 48 and 50, respectively, of the trough 14. The shroud 70 is mounted in vertical alignment with the upstream wall 84 of the expansion chamber 32 to form the restriction 30, while an identical shroud is mounted in vertical alignment with the opposite down stream wall 86 of the expansion chamber to form the second restriction 34.

The shroud 70 (FIG. 4) is roughly trapezoidal, like a wedge-shaped piece of cheese, to fit the trough 14 and is cut away in a semi-circle to clear the feed screw 12. The shroud 70 mounts the shear plate 62 so that its axis of curvature is parallel to the axis of the feed screw 12. The shroud 70 also supports a wear plate 88 on the upstream face of the shroud. This replaceable wear plate 88 serves to stiffen the front of the shroud 70 and prolong its life.

Spacers 90 (FIGS. 2 and 4) fit between the shroud 70 and the walls 48 and 50 of the trough 14". Four such spacers are shown. By varying the thickness of the spacers 90 the size of the clearance 58 can be varied according to particular needs. It has been discovered that having the clearance 58 at about 2.5 inches, while the clearance 60 below is one-half inch, results in a significant increase in through-put of bags and recyclables and that an increase in the upper clearance above 3.5 inches causes an increase in glass breakage.

In the event that some article in a bag gets caught between the wear plate 62 and the flight 42 of the feed screw 12, the motor 18 will continue turning the feed screw 12 until either the article gets drawn through the restriction, the article gets sheared, or the bag opener 10 stalls. During this time the torque on the feed screw 12 tends to deflect the feed screw upward from its position in the trough 14. The trough 14 includes a pair of angles 92 and 94 that are welded to the side walls 48 and 50, respectively, of the trough 14 to stabilize the feed screw 12 when it is under such heavy loads. The angles extend in an upstream direction from the first restriction 30 about one-half the length of the inlet end 16.

The shroud 70, spacers 90, and trough 14 cooperate to form an obround opening, i.e., an opening with semi-circular ends connected by parallel, straight sections. This shape contributes to keeping the feed screw 12 in its desired location. The opening is shaped so that the maximum deflecting forces acting on the feed screw 12 tend to be downwardly directed. This occurs because bags and their contents are drawn into the opening most easily as they turn past the increasingly large clearance 58 at the top of the opening. When the bags and contents reach the apex of the clearance 58, they tend to be squeezed against the shear plate 62, with the resulting force tending the deflect the feed screw 12 in a direction that is below the horizontal midline of the feed screw. The angles 92 and 94 provide additional restraint to keep the feed screw 12 in its desired position by providing a reaction surface for any deflecting forces that are not directed toward the curved bottom portion 46 of the trough 14.

The expansion chamber 32 has a hinged lid 100 which closes the top of the expansion chamber. The lid 100 is hinged along the top of the downstream wall 86 of the box 72. When the bags and their contents reach the expansion chamber 32, most of the bags have been ruptured. Some few bags may have gotten through the first restriction 30 without breaking open. These are agitated by contact with the other recyclable materials in the expansion chamber 32, and desirably reorient themselves so that when they are carried through the second restriction 34, they will be ruptured.

The expansion chamber 32 occasionally fills completely with material when material is passing through the first restriction 30 faster than the second restriction 34. When the expansion chamber 32 fills, the weight of the lid 100 tends to force the accumulated material down into the space between the flight 42 of the feed screw 12. This in turn increases the flow rate through the second restriction 34 and re-establishes equilibrium between the flow rates in and out of the expansion chamber 34. In the event that the flow rates do not equalize, the lid 100, being hinged, lifts, and excess debris spills over the upstream wall 84 of the expansion chamber 32. When this occurs, the excess debris is directed back toward the feed screw 12 by guide walls 102 and 104 (FIGS. 1 and 3) which extend vertically upwardly from the top edges of the trough 14 over a portion of the inlet end 16 of the trough.

The lid 100 has two downwardly depending wings 106 and 108 (FIGS. 1 and 2) which are mounted just inside the edges of the lid adjacent to the front and rear walls 80 and 82, respectively, of the box 70. When the lid 100 is partially open as during an overflow, the wings 106 and 108 prevent the egress of material from the expansion chamber 32 over the front and rear walls 80 and 82, respectively, of the box 70, to the right and left as viewed in FIG. 2. Thus in the event of an overflow or explosion, debris will fall principally over the upstream wall 84 of the expansion chamber 32.

When the recyclable material has passed through the second restriction 34 (FIG. 1), the feed screw 12 pushes it toward the discharge opening 36 which is formed in the bottom of the downstream end of the trough 14. The flight 42 ends short of the end of the tube 40, so that there is a short segment of tube that has no flight. After this short segment, there is a discharge disc 100. The discharge disc is a conical disc, tapering outward and away from the tube 40 toward the end wall 22 which closes the downstream end of the trough 14. The discharge disc 110 deflects materials, especially linear materials such as wire or long strips of plastic that might be wound around the feed screw 12, out toward the discharge opening 36.

Thus it is clear that the present invention provides a number of significant advantages over prior art machines like that shown in U.S. Pat. No. 4,555,212. For example, the trough 14 of the present invention includes a shear plate 52 running the length of the trough under the feed screw 12 to provide added durability and an edge against which bags containing recyclables, especially small bags, may be sheared open. Additionally, a shear plate 62 lines the top part of each restriction 30 and 34. The serrated leading edges 64 of the shear plates 62 engages the bags and friable contents of the bags to help shear them.

The shape of the restrictions 30 and 34 has also been selected to increase effectiveness. To this end each restriction 30, 34 and the trough 14 together make an eccentric opening through which the feed screw 12 passes. The clearance between the feed screw 12 and the restriction 30, 34 is smallest at the bottom of the trough (60) and largest at the top (58), with the clearance being selected to allow ample through-put speeds while keeping breakage of glass to a minimum.

Between the two restrictions 30 and 34 is an expansion chamber 32 covered with a movable lid 100. In the event that recyclable materials build up in the expansion chamber 32, the pressure will cause the lid 100 to lift, thereby alerting the machine operators. The lid 100 is arranged so that as it opens, materials within are exposed only to one direction, toward the inlet end of the trough. Therefore, should the materials overflow the expansion chamber 32, the detritus will flow in only one direction and generally into the inlet 16 for reprocessing.

Additionally, the present invention provides an anti-jamming disc 110 at its discharge end. The disc 110 deflects into the discharge opening materials which might get stuck on the feed screw, such as long pieces of wire or plastic.

What is claimed is:

1. An improved apparatus for rupturing bags of material comprising:

an axially extending transport trough for receiving the bags of material, the trough having an inlet end and an outlet end, a feed screw rotatably mounted in said trough for conveying the bags of material along the trough, said trough surrounding a lower portion of a circumference of the feed screw, a restriction positioned along the trough, the restriction and the trough cooperating to completely surround the feed screw for a portion of a length of the feed screw, the feed screw including a helically wound flight and a replaceable wear surface along the flight where the flight passes through the restriction, and pins projecting perpendicular to the flight and generally in a direction of travel of the material being conveyed by the conveyor flight that is substantially parallel to a longitudinal axis of the trough and which engage bags being conveyed and assist in opening them.

2. The apparatus of claim 1 wherein the pins are bolts which also serve to secure the replaceable wear surface in place on the flight of the conveyor.

3. The apparatus of claim 1 wherein the pins extend approximately two inches beyond the surface of the flight generally in the direction of travel of the material being conveyed.

4. The apparatus of claim 1 including a replaceable wear plate lining an interior of the trough.

5. The apparatus of claim 1 wherein the trough has a cross-section including generally planar sections joined by a continuously curved section, the planar sections being at about a 45 degree angle to each other.

6. The apparatus of claim 5 wherein the trough includes guide bars to position and support the feed screw to keep it centrally located between the planar sections of the trough.

7. An improved apparatus for rupturing bags of material comprising:

an axially extending transport trough for receiving the bags of material, the trough having an inlet end and an outlet end, a feed screw rotatably mounted in said trough for conveying the bags of material along the trough, said trough surrounding a lower portion of a circumference of the feed screw, a first restriction cooperating with the trough and surrounding the feed screw to define an opening through which the feed screw carries the bags of materials, the feed screw including a helically wound flight proportioned to receive a portion of a bag containing material with a remainder of the bag being radially outward of the flight as it is carried from the inlet end of the trough by the feed screw toward the first restriction, the feed screw including a helically wound flight and a replaceable wear surface along the flight where the flight passes through the first restriction, and pins projecting generally in a direction of travel of the material being conveyed by the conveyor flight that is substantially parallel to a longitudinal axis of the trough and which engage bags being conveyed and assist in opening them.

* * * * *